US006796015B2

(12) United States Patent
Cortigiano, Sr.

(10) Patent No.: US 6,796,015 B2
(45) Date of Patent: Sep. 28, 2004

(54) RETRACTABLE ZIPPER GUIDE FOR SLIDER INSERTION APPARATUS

(75) Inventor: Ronald Cortigiano, Sr., Toccoa, GA (US)

(73) Assignee: Illinois Tool Works Inc., Glenview, IL (US)

( * ) Notice: Subject to any disclaimer, the term of this patent is extended or adjusted under 35 U.S.C. 154(b) by 183 days.

(21) Appl. No.: 10/208,307

(22) Filed: Jul. 31, 2002

(65) Prior Publication Data

US 2004/0020025 A1 Feb. 5, 2004

(51) Int. Cl.[7] ..... B21D 53/52; A41H 37/06

(52) U.S. Cl. ..... 29/410; 29/409; 29/766; 29/768

(58) Field of Search ..... 29/408, 409, 410, 29/33.2, 766, 768

(56) References Cited

U.S. PATENT DOCUMENTS

| | | | | |
|---|---|---|---|---|
| 3,701,191 A | | 10/1972 | Laguerre | 29/207.5 |
| 3,701,192 A | | 10/1972 | Laguerre | 29/207.5 |
| 4,581,006 A | * | 4/1986 | Hugues et al. | 493/213 |
| 4,980,968 A | * | 1/1991 | Hilterhaus et al. | 29/768 |
| 6,161,271 A | * | 12/2000 | Schreiter | 29/408 |
| 6,199,256 B1 | * | 3/2001 | Revnew et al. | 29/408 |
| 6,418,605 B1 | * | 7/2002 | Kettner | 29/408 |
| 6,442,819 B1 | * | 9/2002 | Kettner | 29/408 |
| 6,460,238 B1 | * | 10/2002 | LaRue et al. | 29/408 |
| 6,584,666 B1 | * | 7/2003 | Savicki | 29/408 |

* cited by examiner

*Primary Examiner*—Essama Omgba
(74) *Attorney, Agent, or Firm*—Ostrager Chong Flaherty & Broitman P.C.

(57) ABSTRACT

A zipper guide for use in a slider insertion machine in which the zipper guide can be easily loaded with zipper tape without disassembly of the zipper guide. The slider insertion apparatus comprises: an assembly for inserting sliders onto a zipper tape; first and second shafts that are fixed relative to the assembly; a zipper guide for guiding the zipper tape during longitudinal movement of the zipper tape and supporting the zipper tape during slider insertion; and a retainer coupled to the first shaft and movable between first and second retainer positions. The zipper guide comprises a stationary part that is fixed relative to the assembly and comprises a first groove, and a rotatable part that is rotatable about the second shaft between first and second angular positions and comprises a second groove. The retainer is coupled to the rotatable part in the first retainer position to block rotation of the rotatable part and is uncoupled from the rotating part in the second retainer position to not block rotation of the rotatable part.

30 Claims, 10 Drawing Sheets

RETRACTABLE ZIPPER GUIDE FOR SLIDER INSERTION APPARATUS

BACKGROUND OF THE INVENTION

This invention generally relates to slider-operated plastic zippers intended for use in reclosable pouches, bags or other packages. In particular, the invention relates to methods and apparatus for inserting sliders on zippers.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Other types of slider-operated zipper assemblies avoid the use of a separating finger. For example, U.S. Pat. No. 6,047,450 discloses a zipper comprising a pair of mutually interlockable profiled structures, portions of which form a fulcrum about which the profiled structures may be pivoted out of engagement when lower edges of the bases are forced towards each other. The slider disclosed in U.S. Pat. No. 6,047,450 comprises features that facilitate the insertion of a slider onto the zipper of a reclosable bag. More specifically, the slider can be inserted over a closed zipper without the requirement of first separating the interlocking members of the zipper.

An improvement in sliders is disclosed in U.S. patent application Ser. No. 10/096,409 filed on Mar. 11, 2002 and entitled "Insertion Apparatus for Attaching Sliders onto Zipper Bags and Film". This slider can be inserted on the zipper in a manner such that the zipper will be secured in the slider. As a result, during an opening of the reclosable bag the interlocking closure elements of the zipper will not unintentionally re-engage within the slider. For example, a re-engagement of the interlocking closure elements could occur when the zipper opening end of the slider is pushed toward a closed zipper park position. Such a re-engagement can occur during operation of the zipper or if the slider is inserted too far from a slider end stop on the zipper. By reducing the possibility of unintentional re-engagement of the interlocking members of the profiles, production of defective bags is reduced.

U.S. patent application Ser. No. 10/096,409 further discloses a slider insertion apparatus comprising an activator with pusher that opens a first portion of the zipper, an insertion cylinder that inserts the slider onto a second portion of the zipper, and a zipper guide that holds a third portion of the zipper closed. The zipper guide and the activator with pusher are manufactured to facilitate movement of the zipper within the slider insertion apparatus; to properly position the profiles of the zipper for slider insertion; and to secure the zipper when the slider is inserted onto the zipper. A loading rack with a supply of sliders may be part of the slider insertion apparatus, with the loading rack being a mechanically attachable device or module.

In the slider insertion process, a closed zipper is guided by a pair of opposing grooves formed in opposing parts of the zipper guide to an insertion point under the activator with pusher. An activating fork of the activator with pusher offsets the interlocking members in a section adjacent to where the slider is inserted. The slider is inserted onto the interlocked zipper by the pusher. The interlocked zipper is supported in the area where the slider is inserted by a pair of guide blades. When it becomes necessary to either remove or install a zipper tape, e.g., during initial setup or unjamming of the slider inserter, one zipper guide part must be unfastened and disengaged. The disassembly and assembly of the zipper guide can be a laborious operation.

There is a need for an alternative design of a zipper guide that will enable a zipper tape to be installed or removed more easily, without disassembly of the zipper guide.

BRIEF DESCRIPTION OF THE INVENTION

The present invention is directed to a zipper guide, e.g., for use in a slider insertion machine, that can be easily loaded with zipper tape without disassembly of the zipper guide.

One aspect of the invention is an apparatus comprising: a support structure; a first guide part supported by the support structure and comprising a first groove; and a second guide part supported by the support structure and comprising a second groove; and a retainer coupled to the support structure and having first and second states. The retainer is coupled to the second guide part in the first state and is uncoupled from the second guide part in the second state. The second guide part is locked in an extended position confronting the first guide part when the retainer is in the first state; the second guide part is movable between the extended position and a retracted position not confronting the first guide part when the retainer is in the second state. The first and second grooves are configured and disposed on the first and second guide parts respectively such that when the second guide part is in the extended position, the first and second grooves are in an opposed spaced parallel positional relationship. These confronting grooves form a guide for a section of closed zipper captured therebetween.

Another aspect of the invention is an apparatus comprising: a zipper guide for guiding a zipper tape during longitudinal movement and supporting the zipper tape during slider insertion; a pusher for inserting a slider onto a first section of the zipper tape; and an activator for activating a second section of the zipper tape, wherein the first and second sections overlap. The zipper guide comprises first and second guide parts having first and second grooves respectively, the first guide part being fixed and the second guide part being movable between extended and retracted positions. The first and second grooves are opposed to each other when the second guide part is in the extended position and not opposed to each other when the second guide part is in the retracted position.

A further aspect of the invention is a slider insertion apparatus comprising: an assembly for inserting sliders onto a zipper tape; and a zipper guide for guiding the zipper tape during longitudinal movement of the zipper tape and supporting the zipper tape during slider insertion. The zipper guide comprises first and second grooves and a spring-loaded release mechanism. The first and second grooves are opposed to each other when the zipper guide is in a first state and not opposed to each other when the zipper guide is in a second state. The zipper guide is transformed from the first state to the second state by manual operation of the release mechanism.

Yet another aspect of the invention is a slider insertion apparatus comprising: an assembly for inserting sliders onto a zipper tape; first and second shafts that are fixed relative to the assembly; a zipper guide for guiding the zipper tape during longitudinal movement of the zipper tape and supporting the zipper tape during slider insertion; and a retainer coupled to the first shaft and movable between first and second retainer positions. The zipper guide comprises a stationary part that is fixed relative to the assembly and comprises a first groove, and a rotatable part that is rotatable about the second shaft between first and second angular positions and comprises a second groove. The retainer is coupled to the rotatable part in the first retainer position to block rotation of the rotatable part and is uncoupled from the rotating part in the second retainer position to not block rotation of the rotatable part.

A further aspect of the invention is a method of loading a slider insertion machine with zipper tape, comprising the following steps: unlatching a rotatable guide part; rotating the unlatched rotatable guide part from a first angular position, where a first groove of the rotatable guide part confronts a second groove of a stationary guide part, to a second angular position, where the first groove does not confront the second groove; laying a zipper tape on the stationary guide part in a position whereat a zipper profile is seated in the second groove; rotating the rotatable guide part from the second angular position to the first angular position without moving the zipper profile out of the second groove; and latching the rotatable guide part.

Other aspects of the invention are disclosed and claimed below.

DETAILED DESCRIPTION OF THE INVENTION

Figure 1:
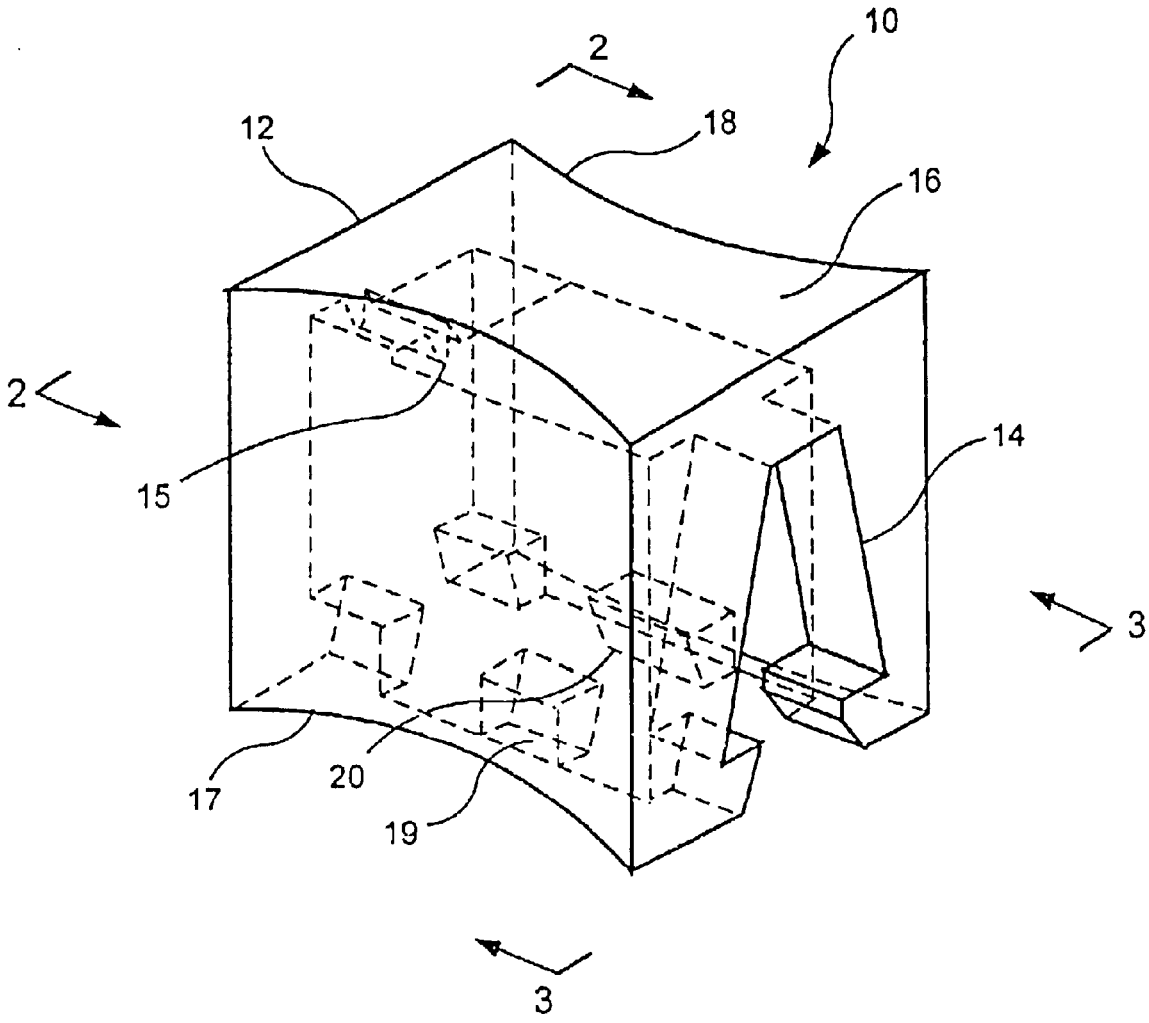
FIG. 1 is a drawing showing an isometric view of one type of slider that can be inserted on a zipper using the slider insertion apparatus disclosed herein.

Reference will now be made to the drawings, in which similar elements in different drawings bear the same reference numerals. For the purpose of illustration, the present invention will be described with reference to insertion of a slider of the type depicted in FIG. 1. However, application of the retractable zipper guide of the present invention is not limited to sliders of the type described below.

The slider 10 shown in FIG. 1 comprises a top wall 16 and opposing side walls or arms 17 and 18 integrally with opposite sides of the top wall 16, forming a channel having a zipper opening end 12 and a zipper closing end 14. The slider comprises a keeper 15 extending downward from the top wall 16 and disposed between arms 17 and 18. The slider further comprises a plurality of mutually aligned, longitudinally extending retaining shoulders 19 projecting from the side wall 17, and a plurality of mutually aligned, longitudinally extending retaining shoulders 20 projecting from the side wall 18. The retaining shoulders 19 and 20 are shown as separate; however, the shoulders may be continuous along the length of the slider 10.

Figure 2:
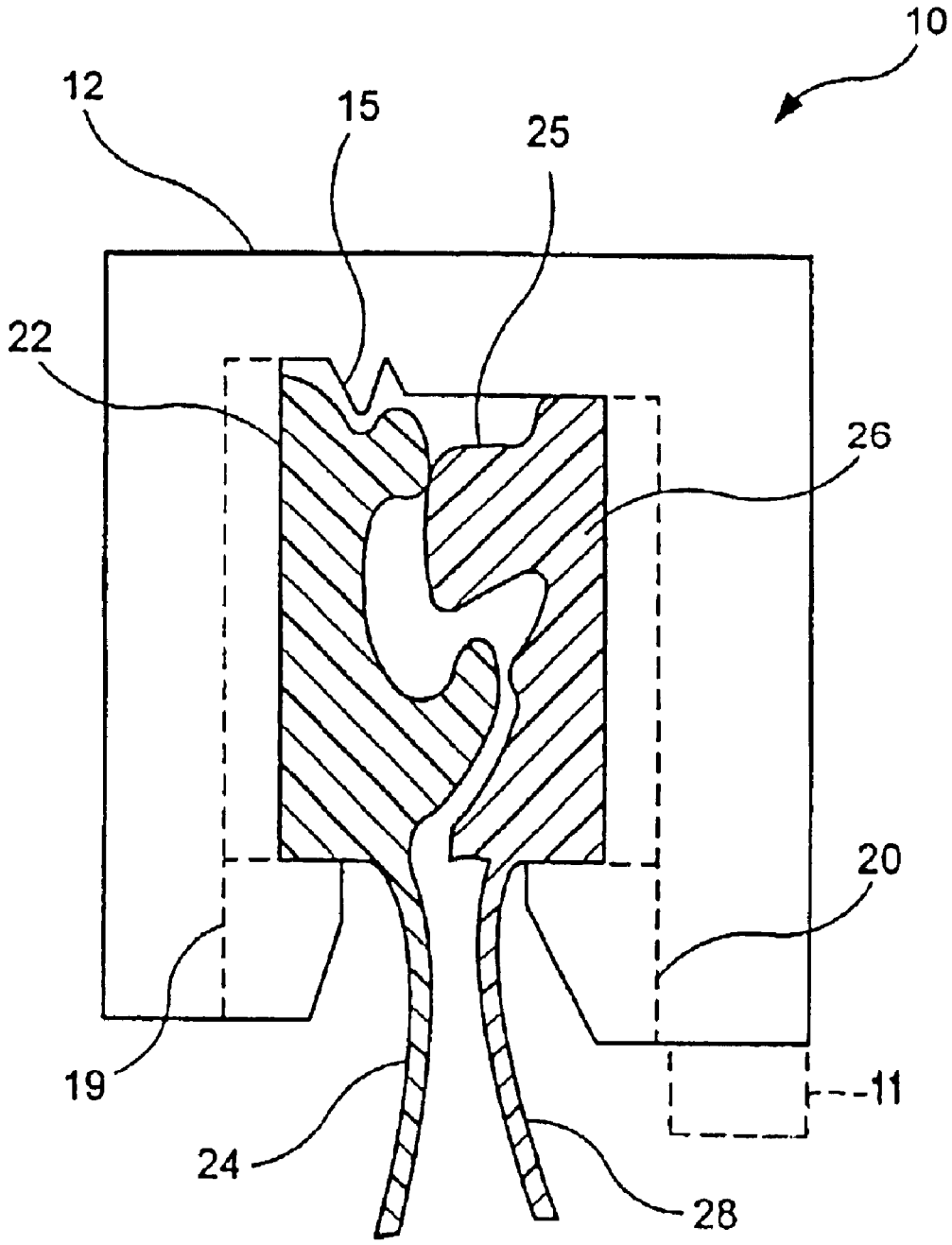
FIGS. 2 and 3 are drawings showing respective end views of the zipper opening end and zipper closing end of the slider depicted in FIG. 1, with the slider shown encompassing a portion of a zipper.

The keeper 15, as well as the retaining shoulders 19 and 20, secure a zipper within the slider 10, as shown in FIG. 2. FIG. 2 is an end view of the zipper opening end of the slider 10 with the slider shown encompassing a portion of a zipper 25 of a type known to those skilled in the art. In the state depicted in FIG. 2, the keeper 15 secures an interlocking member 22 of zipper part or half 24 of zipper 25 by preventing the interlocking member 22 from moving toward the mating interlocking member 26 of zipper part or half 28. If the interlocking members are formed of a sufficiently stiff material, the interlocking member 22 may include a slight recess to accommodate the keeper 15. By preventing movement of the interlocking member 22 towards the interlocking member 26, the zipper parts 24 and 28 always remain partially disengaged at the opening end, thereby reducing the possibility of an unintentional full engagement of the interlocking members within the slider.

Figure 3:
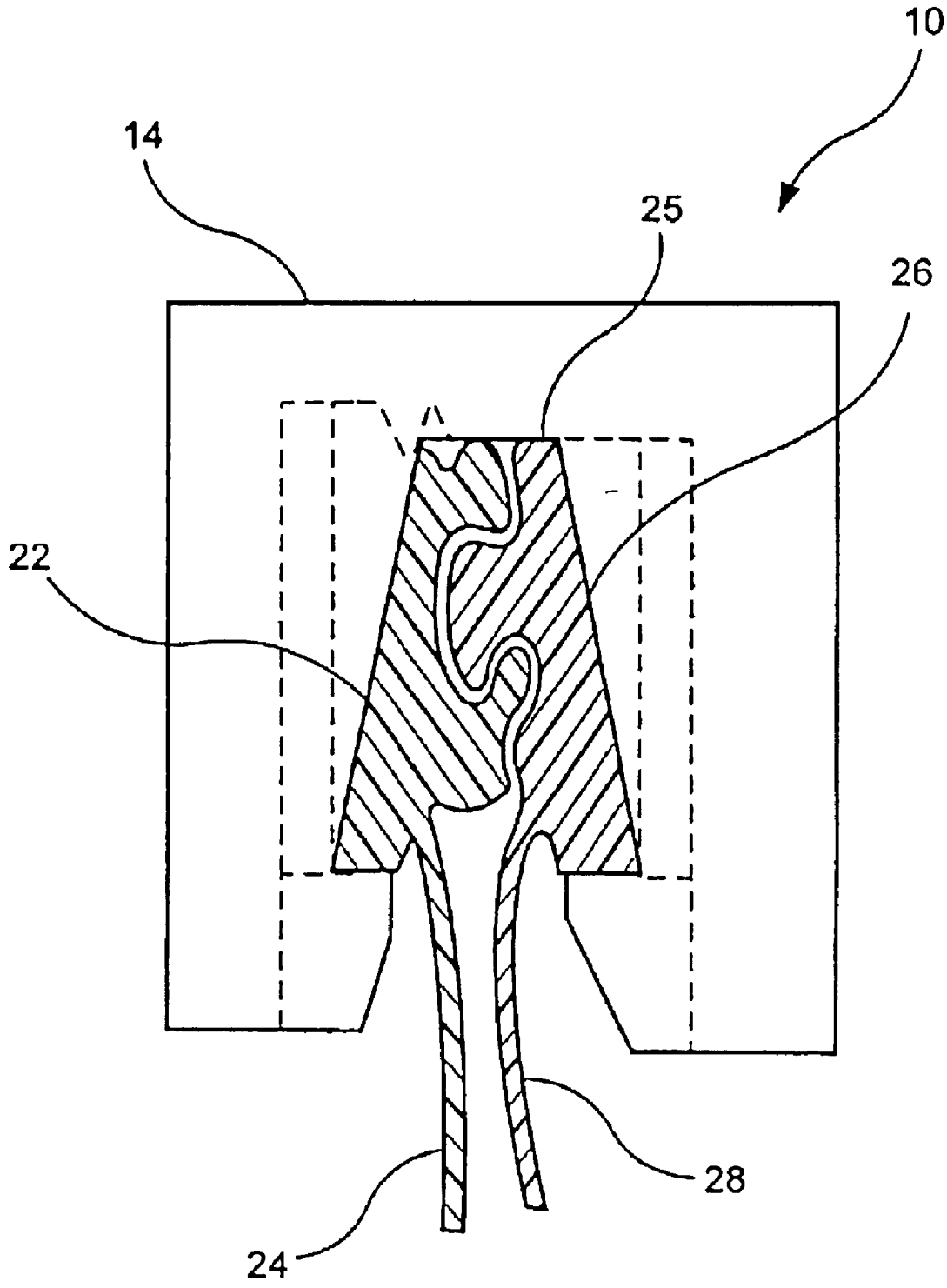

The arms of the slider are designed with interior surfaces having lower portions that converge in a direction from the opening end of the slider to the closing end, and having upper portions that diverge in the same direction. The lower portions on the interior surfaces of the slider arms 17 and 18 press the bottom edges of the interlockable members 22 and 26 toward each other when the slider is moved in the closing direction. These members are designed with surfaces that cooperate to form a fulcrum, about which the interlockable members rotate when their bottom edges are pressed together, causing the zipper portions above the fulcrum point to separate. In particular, the male and female profiles disengage, thereby opening the zipper as seen in FIG. 2. Conversely, when the slider is moved in the opposite or opening direction, the upper portions of the interior surfaces of the slider arms press the upper portions of the interlockable members 22 and 26 together, causing the zipper to close, as seen in FIG. 3.

To facilitate automatic feeding from a source of sliders, such as a vibratory hopper, which is connected to the loading rack of the slider insertion device (described below) via a molded feed tube (not shown), each slider may have a downward projection 11 (indicated by dashed lines in FIG. 2) on one side only. The feed tube would have a channel with a recess that matches the slider profile with downward projection 11. Since the slider profile in this case is not symmetrical, the slider can be fed from the hopper to the loading rack only if the slider is oriented correctly with keeper 15 on the side required by the slider insertion device.

Figure 4:
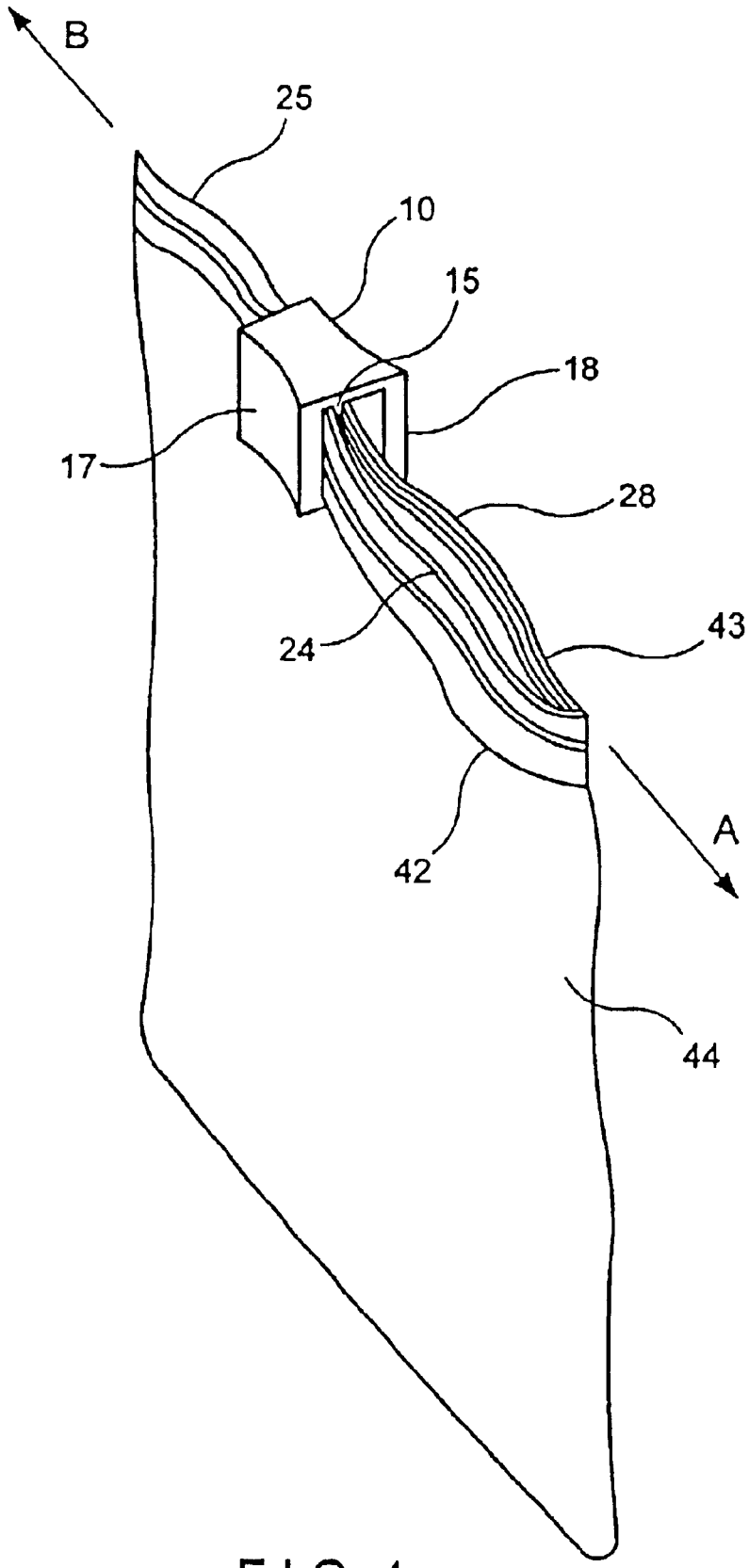
FIG. 4 is a drawing showing an isometric view of a reclosable plastic bag having a zipper operated by the slider shown in FIGS. 1–3.

FIG. 4 is an isometric view of a reclosable bag 44 incorporating a slider 10 and a zipper 25 of the above-described types. The zipper 25 is disposed across the transverse top edges 42 and 43 of the front and rear walls of reclosable bag 44. In use, the straddling slider 10 is slidable along the zipper in a closing direction A to cause the interlocking members 22 and 26 to be fully engaged. When the slider 10 is moved in an opening direction B, the interlocking members are disengaged by pinching the arms 17 and 18 at the zipper opening end 12 of the slider 10.

Figure 5:
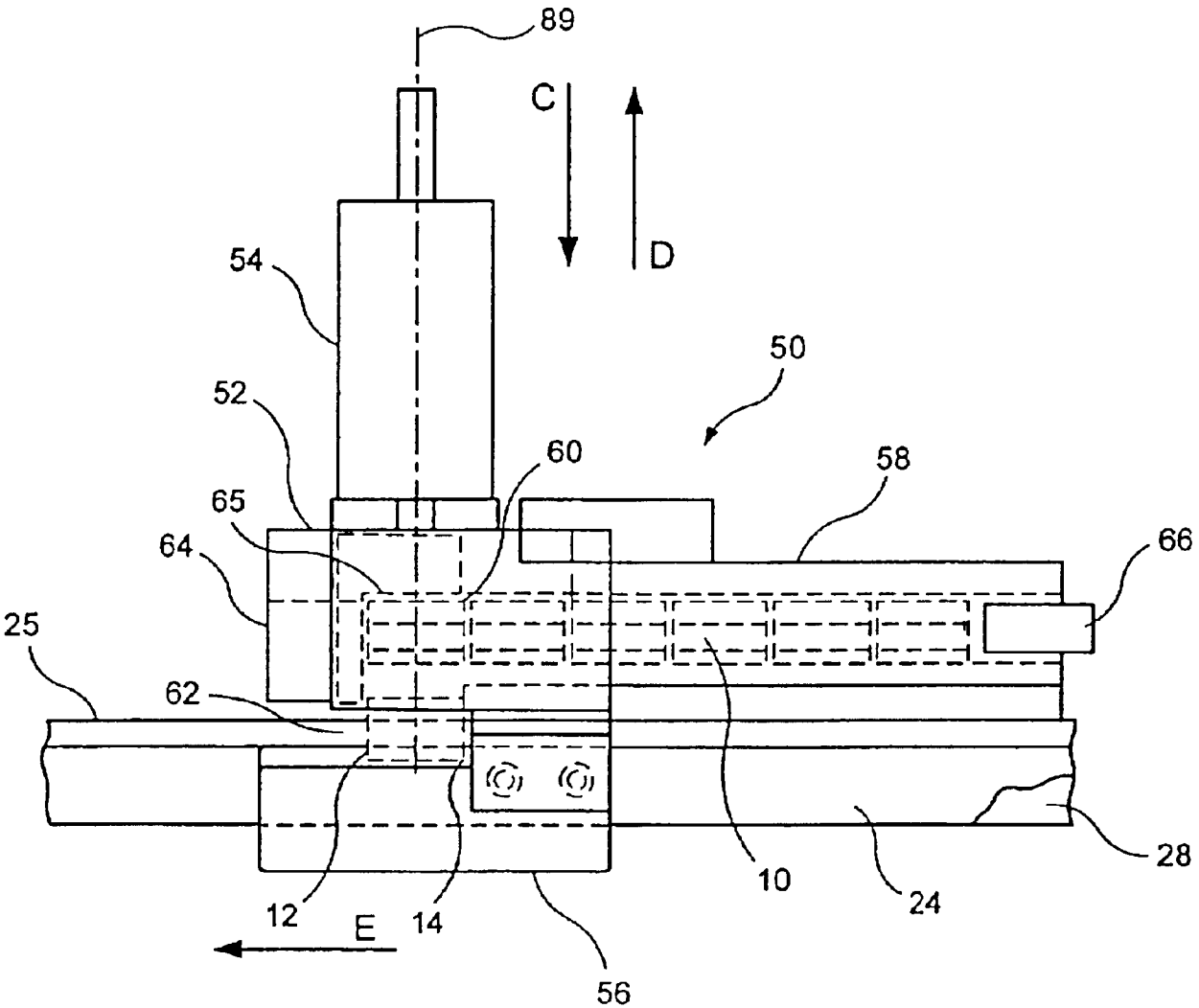
FIG. 5 is a drawing showing a side view of a slider insertion apparatus having a horizontal slider loading rack.

FIG. 5 is a side view depicting one type of slider insertion apparatus 50 in which sliders are intermittently and successively inserted on a continuous zipper tape, which will be cut later to form successive zippers 25. Prior to being fed to the slider insertion apparatus, the zipper tape may be stomped at package intervals to form slider end stops (not shown).

The slider insertion apparatus comprises an activator with pusher 52, an insertion cylinder 54 and a zipper guide 56. A loading rack 58 is a horizontal magazine-type rack supplying individual sliders 10 at an entry point 60. The loading rack may be part of the slider insertion apparatus 50 or may be mechanically attached to the slider insertion apparatus. Although a linear rack is shown in FIG. 5, alternatively the loading rack may be curved.

Still referring to FIG. 5, the activator with pusher 52 comprises an activating fork 64. During an insertion in slider insertion area 62, the activating fork 64 is moved in direction C and during its descent, vertically offsets the interlocking members 22 and 26 of a zipper 25 in an area adjacent the slider insertion area 62. This causes the vertically offset portions to disengage, i.e., partly open. In the specific embodiment shown in FIG. 5, a zipper guide 56 guides the zipper tape 25 toward the slider insertion area 62. Although FIG. 5 depicts a guide blade attached to the base of the slider insertion apparatus by means of an attachment piece to which the blade is fastened, the blade and attachment means can be formed as a unitary piece, as will be seen in later drawings.

Coinciding with the movement of the activating fork 64 in direction C, a pusher 65 of the activator with pusher 52 inserts the slider 10 on the zipper tape. The activator with pusher 52 is driven in direction C with a force exerted by the insertion cylinder 54. The insertion cylinder 54 is preferably pneumatically driven. The activation fork 64 and pusher 65 can be driven, as shown, by a single cylinder or, in the alternative, by separate cylinders.

After insertion of the slider 10 onto the zipper 25, the activator with pusher 52 retracts in direction D. This retraction movement allows the loading rack 58 to pneumatically deliver another slider 10 to the slider insertion apparatus 50 at the entry point 60. The slider 10 may be delivered pneumatically or a mechanical pawl 66 may also be used on the loading rack 58 for moving the slider 10 to the slider insertion apparatus. The mechanical pawl 66 is typically used if the insertion rate requirements must be in excess of a few per minute.

The zipper guide 56 then guides a next length of zipper tape (corresponding to the next zipper) in direction E into the slider insertion apparatus 50. As each section of the zipper tape 25 enters and advances through the zipper guide 56, a pair of opposing grooves form a channel that matches the overall profile of the zipper to prevent the zipper from opening or rolling from side to side, contributing to a stable insertion of each slider 10.

FIG. 5 shows the case where activation occurs forward of the slider insertion area (the forward direction being indicated by arrow E in FIG. 5). However, the positions of the activating fork and pusher can be reversed so that activation occurs to the rear of the slider insertion area.

Figure 6:
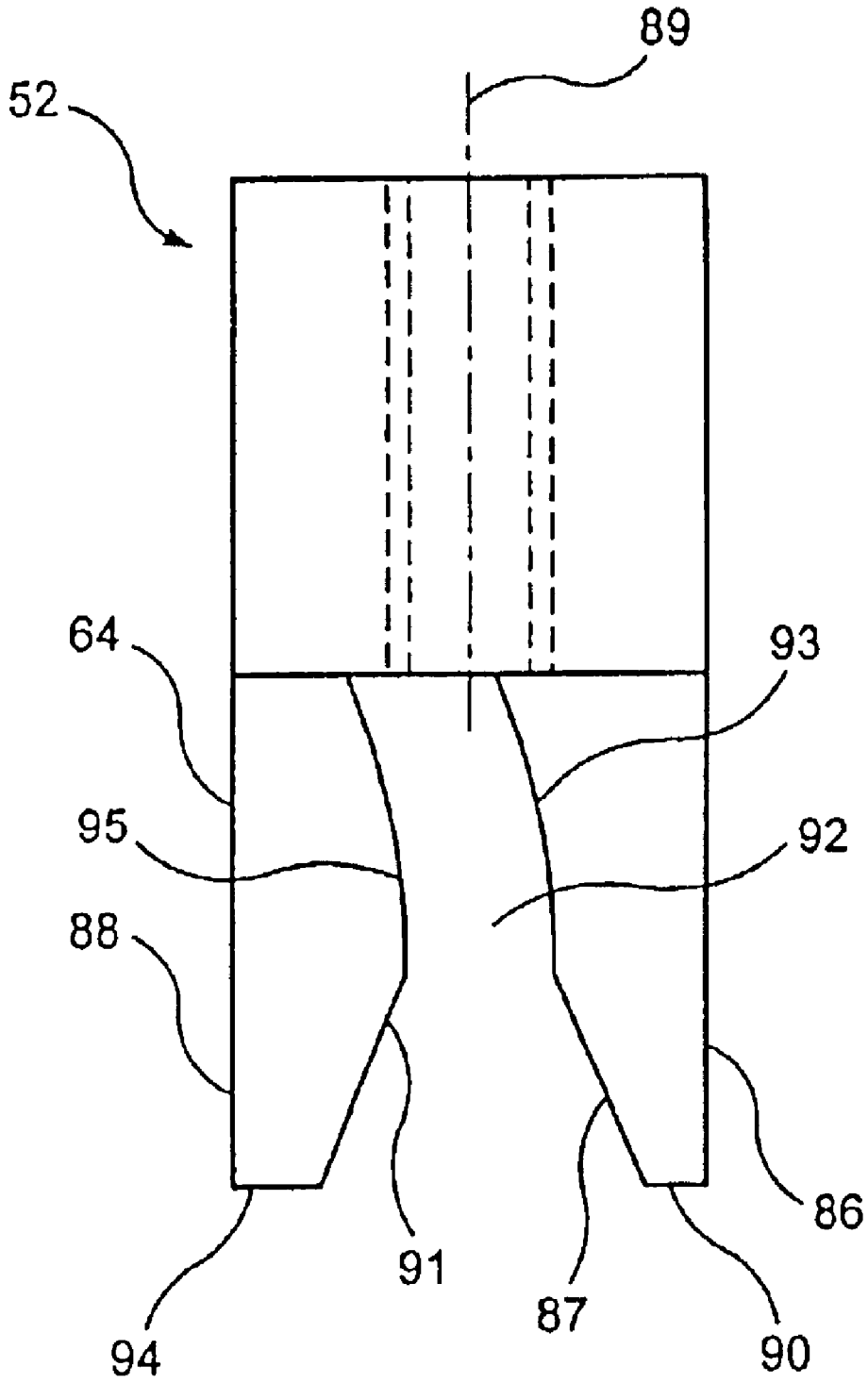
FIG. 6 is a drawing showing an end view of an activating fork that is used to activate a section of zipper adjacent where the slider is inserted.

In the offsetting or activating action, the interlocking members are partially disengaged but are not separated. When the interlocking members 22 and 26 are offset in relation to each other, the keeper 15 can properly secure the interlocking member 22, as seen in FIG. 2. The offsetting action is produced by an activating fork of the type shown in FIG. 6. The activating fork 64 comprises a pair of arms or fins 86 and 88. From respective lower ends 90, 94, the inner surfaces of the lower portions 87, 91 of the fins chamfer towards a central vertical plane 89. These chamfers facilitate entry of the zipper profiles into the activating fork when the latter is pushed onto the zipper. The interior surface of upper portion 93 of fin 86 further tapers toward the vertical plane 89 and the interior surface of upper portion 95 of the opposite fin 88 tapers parallel to the upper portion 93 of the fin 86, i.e., tapers away from the vertical plane 89. During travel upward (as seen in FIG. 6) through the channel 92, the zipper profiles are deflected sideways by the contoured surface 93, so that the sections of zipper profiles in the channel 92, as well as the contiguous sections under the inserted slider and adjacent the keeper 15 (see FIG. 2), become vertically offset. More specifically, the portion of the zipper part with female profile that underlies keeper 15 in the slider is offset, as seen in FIG. 2, and thus is secured within the slider by the keeper. Thus, the zipper section at the opening end of the slider is activated in the sense of being held open by the keeper.

A zipper guide in accordance with one embodiment of the present invention will now be described with reference to FIGS. 7–13. This zipper guide comprises a lower guide blade 30 and an upper guide blade 32, both of which are fastened to a support structure, e.g., a base of a slider insertion machine. Unlike the zipper guide shown in FIG. 5, the zipper guide depicted in FIGS. 7–13 guides a zipper tape that is oriented in a horizontal plane, the slider being likewise inserted in a horizontal direction.

Figure 7:
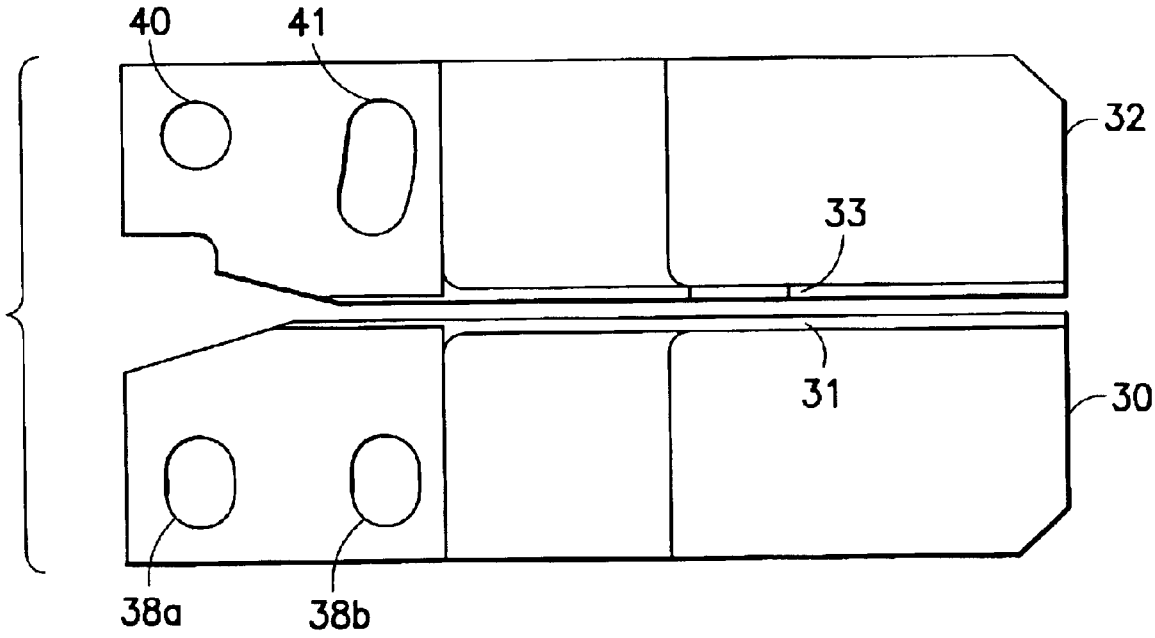
FIGS. 7 and 8 are drawings showing side and end views of a zipper guide comprising upper and lower guide blades in accordance with one embodiment of the present invention.
Figure 8:
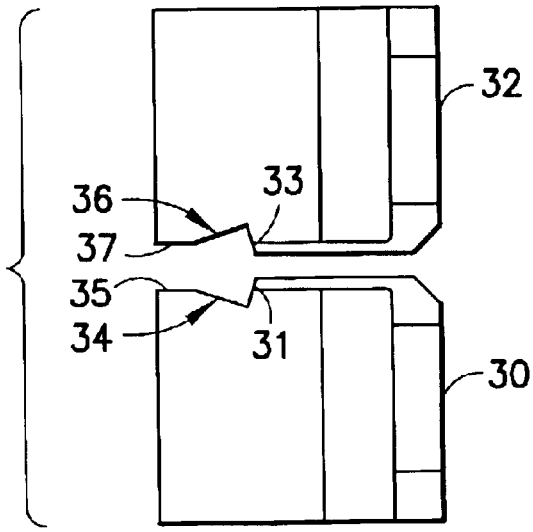
Figure 9:
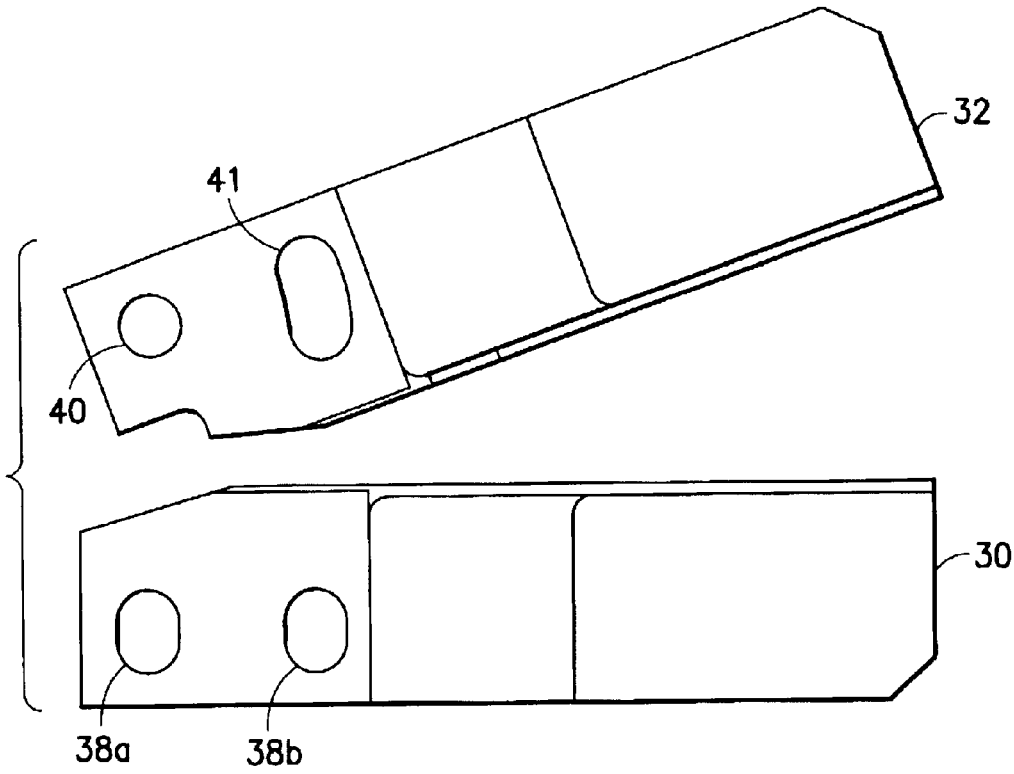
FIG. 9 is a drawing showing a side view of the zipper guide depicted in FIG. 8 with the upper guide blade retracted.

FIGS. 7 and 8 show, from two vantages, the relative positions of the upper and lower guide blades during slider insertion; FIG. 9 shows the upper guide blade 32 retracted from the lower guide blade to allow insertion or removal of a zipper tape from between the guide blades. The upper guide blade 32 is depicted in FIG. 9 as being rotatable relative to the support structure.

Figure 10:
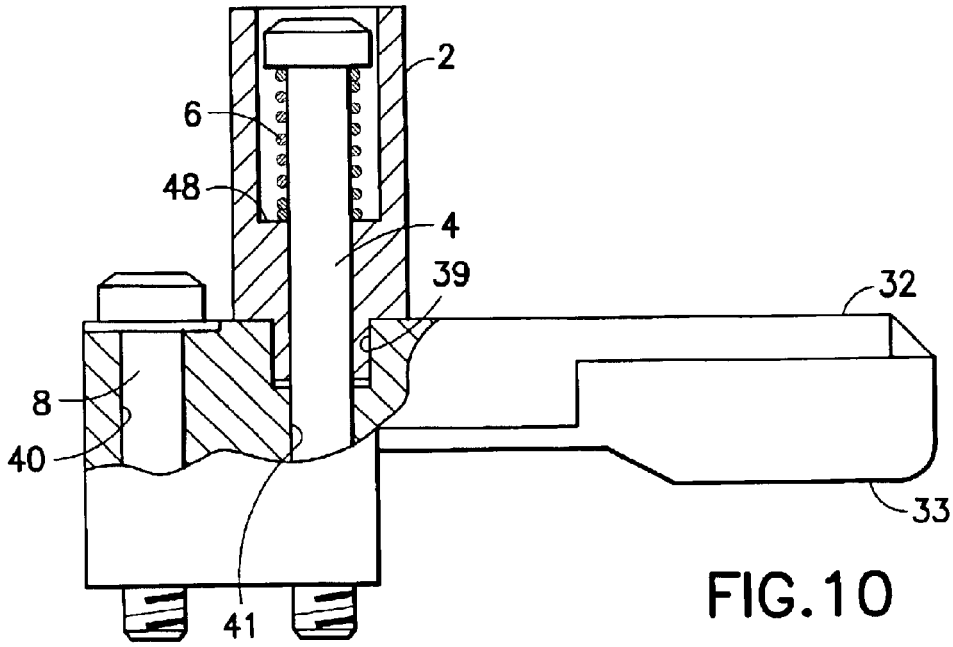
FIG. 10 is a drawing showing a partially sectioned top view of the retractable upper guide blade and associated retaining pin.

As seen in FIGS. 7 and 9, the upper guide blade has an unthreaded circular bore 40 and a radiused slot 41. The radiused slot 41 has a radius centered at a center line of bore 40. As seen in FIG. 10, a short screw 8 is passed through the bore 40 and screwed into the support structure (not shown in FIG. 9). The short screw 8 has a threaded end, but is not threaded along that portion of its shaft that is inside bore 40. The radius of the unthreaded shaft portion of screw 8 is slightly less than the radius of bore 40, allowing the upper guide blade 32 to rotate on screw 8. A long screw 4 is passed through the radiused slot 41 and screwed into the support structure. Like the short screw, the long screw 4 has a threaded end, but is not threaded along that portion of its shaft that is inside slot 41. As a result of this geometry, the upper guide blade 32 is rotatable, under conditions to be described below, about the shaft of screw 8 through an angle determined by the arc length of the radiused slot 41. In the example depicted in FIGS. 7 and 9, the upper guide blade is rotatable through an angle of 20 degrees relative to the support structure. However, the invention is not limited to any particular angle of rotation.

In contrast to the rotatable upper guide blade 32, the lower guide blade is fixedly fastened to the support structure by means of a pair of screws (not shown). As seen in FIG. 9, the lower guide blade 30 is provided with a pair of bores 38*a* and 38*b*, each bore having an oval or racetrack cross section. This elongated cross section allows the position of the lower guide blade to be adjusted up or down relative to the fasteners as necessary.

Referring to FIG. 8, it can be seen that the lower guide blade 30 has a V-shaped longitudinal groove 34 and the upper guide blade 32 has a V-shaped longitudinal groove 36. These grooves are configured and disposed on the guide blades such that when the upper guide blade is in the extended position shown in FIG. 7, the grooves 34 and 36 are in an opposed spaced parallel positional relationship, thereby forming a guide for a section of closed zipper captured between the grooves. The grooves are mirror images of each other and are generally shaped to guide an A-shaped zipper profile, such as that shown in FIG. 3. However, for zipper profiles that are not A-shaped, the grooves may be redesigned as necessary to guide the zipper profile.

Figure 14:
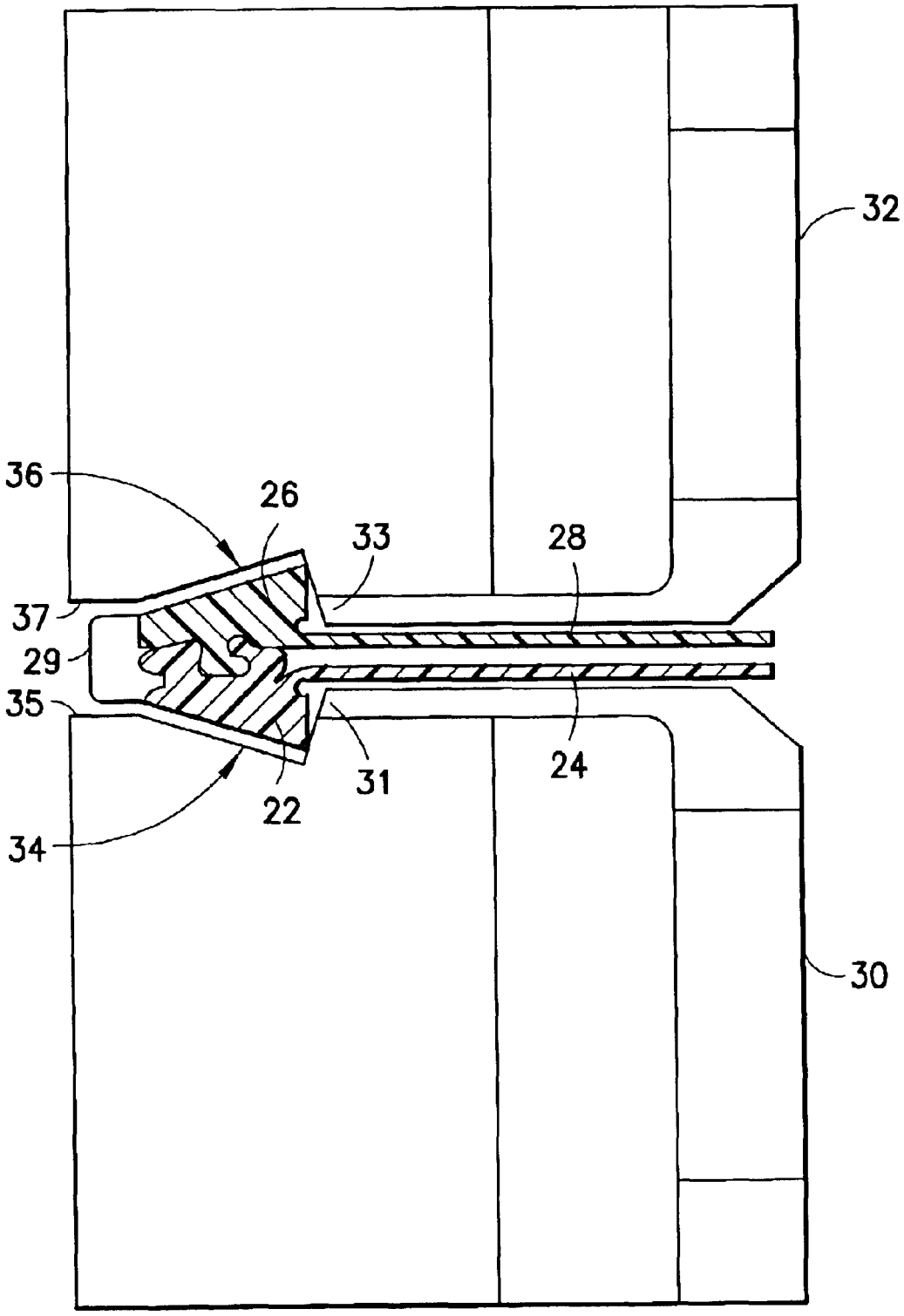
FIG. 14 is a drawing showing a portion of the structure depicted in FIG. 8, that portion being drawn at a greater scale and with a zipper tape (shown in section) inserted between the guide blades.

To illustrate the functionality of the zipper guide, a portion of FIG. 8 has been magnified in FIG. 14 and the relative position of the zipper tape 25 has been indicated in cross section. The upper guide blade 32 comprises a first surface 37 on one side of groove 36 and a second surface on the other side of groove 36, while the lower guide blade further comprises a third surface 35 on one side of groove 34 and a fourth surface on the other side of groove 34. The surfaces 35 and 37 are mutually opposed and separated by a first spacing, while the second and fourth surfaces (not numbered in FIG. 14) are mutually opposed and separated by a second spacing less than the first spacing. The first spacing is selected to allow slider end stops 29 on the zipper to pass with clearance between the upper and lower guide blades. For example, the slider end stops are formed by ultrasonically stomping the zipper profiles together to form an upwelled mass of thermoplastic material, which upwelled mass forms the end stop 49. Ultrasonic stomping may be performed at an earlier stage in the automated production line, the zipper tape being advanced intermittently one package width between stomping operations. The second spacing is selected to allow the zipper flanges of the zipper to pass between the opposing second and fourth surfaces, as seen in FIG. 14.

Figure 12:
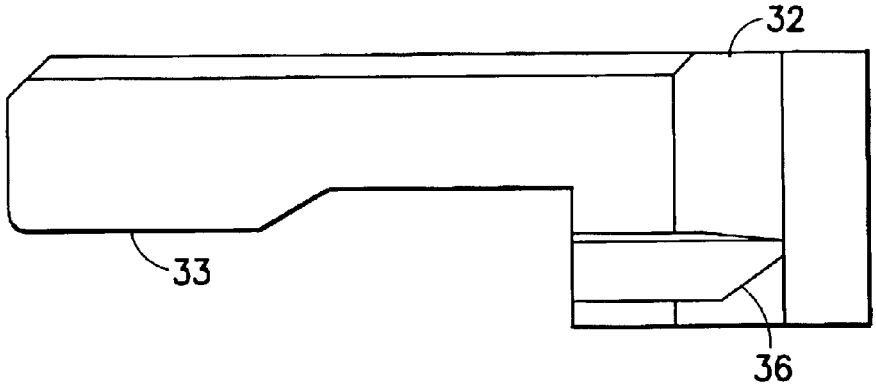
Figure 13:
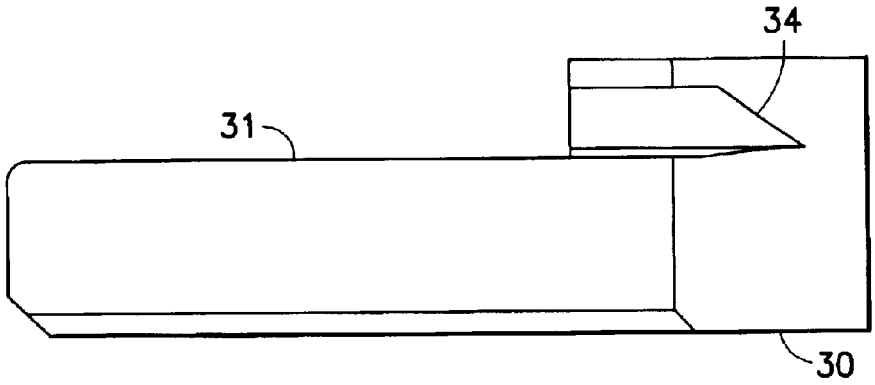
FIG. 13 is a drawing showing a top view of the lower guide blade.

As seen in FIG. 12, the upper guide blade 32 comprises a straight blade edge 33 that is substantially aligned with an edge of the groove 36. That is because the blade edge 33 is intended to support the bottom of one zipper profile, as does the edge of groove 36. The alignment of blade edge 33 and the edge of groove 36 is best seen in FIG. 14. Similarly, now referring to FIG. 13, the lower guide blade 30 comprises a straight blade edge 31 that is substantially aligned with an edge of the groove 34. That is because the blade edge 31 is intended to support the bottom of the other zipper profile, as does the edge of groove 34. The alignment of blade edge 31 and the edge of groove 34 is also seen in FIG. 14. The zipper profiles in the zipper section where the slider is being inserted are supported by the blade edges 31 and 33, opposing displacement of the zipper as the slider is pushed on. The blade edges extend in parallel spaced relationship when the upper guide blade is in the extended position, with the zipper flanges sandwiched between the blades as shown in FIG. 14.

Figure 11:
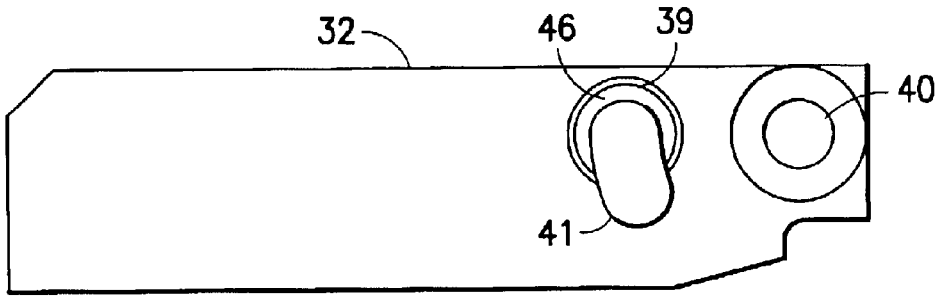
FIGS. 11 and 12 are drawings showing additional views of the upper guide blade as seen from one side and from the bottom respectively.

Referring to FIGS. 10 and 11, the mechanism for enabling the upper guide blade to be manually retracted without disassembly of the zipper guide will now be described. As previously described, the radiused slot 41 in the upper guide blade 32 is penetrated by a long screw 4, the threaded end of which is secured to a support structure. In the absence of any interference, the upper guide blade 32 can rotate about the short screw 8 over an angular range dictated by the abutment of the respective ends of the radiused slot against the shaft of screw 6. Each end of the radiused slot 41 comprises a respective semicircle having a radius slightly greater than the radius of the shaft of screw 4.

In accordance with the embodiment shown in FIGS. 10 and 11, a retaining mechanism is provided which can be manually operated to alternately secure the upper guide blade in the extended position shown in FIG. 7 or release the upper guide blade to allow rotation away from the extended position, e.g., to the retracted position shown in FIG. 9. The retainer takes the form of a spring-loaded retaining pin 2 that is slidably mounted on the unthreaded shaft of the long screw 4. One end of the retaining pin 2 forms a key that fits in a keyhole 39 (see FIG. 11) formed in the upper guide blade 32. In the disclosed embodiment, the key end of the retaining pin is a circular cylinder and the keyhole takes the form of a recess defined in part by a surface of revolution that forms an arc greater than 180 degrees and a section 46 of an annular surface that extends from one end of the surface of revolution to an edge of the radiused slot 41. The arc of recess 39 has a radius slightly greater than the radius of the key end of the retaining pin, allowing the key end of the retaining pin 2 to be inserted in the recess 39. This coupling of the retaining pin 2 and the upper guide blade 32 (as shown in FIG. 10) blocks rotation of the upper guide blade, since the retaining pin is constrained against displacement by the screw 4 except along the screw axis. The key and keyhole may have matching shapes other than circles.

The retaining pin 2 is held in the position shown in FIG. 10 by a compression spring 6, one end of which presses the retaining pin toward the guide blade and the other end of which is seated under the head of screw 4. The retaining pin 2 has a bore comprising first and second circular cylindrical bore sections that are coaxial, but of different diameter. The first bore section has a radius slightly greater than the radius of the shaft of screw 4, and the second bore section has a radius greater than the radius of the head of screw 4. The spring 6 is seated in an annular space between the retaining pin 2 and the shaft of screw 4. The end of the spring 6 bears against the head of screw 4 while the other end of spring 6 bears against an annular shoulder 48 where the bore sections meet.

When a zipper tape needs to be loaded or unloaded from an automatic slider insertion machine, a system operator can retract the upper guide blade 32 by overcoming the force exerted by spring 6 and pulling the retaining pin 2 out of the keyhole formed in the upper guide blade. When the retaining pin is disengaged, the upper guide blade can be rotated from the extended position to a retracted position. With the upper guide blade in a retracted position, the key end of the retaining pin 2 will be urged against the face of the upper guide blade by the spring 6 at a location removed from the keyhole. A zipper tape can be loaded while the upper guide blade is in a retracted position. The system operator can then rotate the upper guide blade back to the extended position, taking care to maintain the zipper profile in the groove of the lower guide blade and to direct the other side of the zipper profile into the confronting groove of the upper guide blade. The system operator can then release the retaining pin into the keyhole to lock the upper guide blade in place, with the zipper tape securely threaded between the upper and lower guide blades.

In the embodiments disclosed hereinabove, the zipper guide comprises upper and lower guide blades that incorporate means for attachment to a support structure, such as a base of a slider insertion machine. However, the zipper guide may comprise stationary and rotatable guide parts, which in turn each comprise a guide blade fastened to an attachment piece.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "coupled" does not include the simple case where one planar surface abuts another planar surface. Also, the term "part" is meant to encompass both a single unitary component or an assembly of components.

What is claimed is:

1. An apparatus comprising:

a support structure;

a first guide part supported by said support structure and comprising a first groove;

a second guide part supported by said support structure and comprising a second groove; and a retainer coupled to said support structure and having first and second states, said retainer being coupled to said second guide part in said first state and being uncoupled from said second guide part in said second state, wherein said second guide part is locked in an extended position confronting said first guide part when said retainer is in said first state, and said second guide part is movable between said extended position and a retracted position not confronting said first guide part when said retainer is in said second state, said first and second grooves being configured and disposed on said first and second guide parts respectively such that when said second guide part is in said extended position, said first and second grooves are in an opposed spaced parallel positional relationship, thereby forming a guide for a section of a closed zipper captured between said first and second grooves.

2. The apparatus as recited in claim 1, further comprising a zipper having a closed section disposed between said first and second grooves, wherein said first and second grooves have profiles that guide said closed section of said zipper in a longitudinal direction only.

3. The apparatus as recited in claim 1, wherein said support structure comprises a support base and first and second fasteners coupled to said support base, and said retainer comprises a retaining pin slidable on said first fastener.

4. The apparatus as recited in claim 3, wherein said second guide part comprises a radiused slot penetrated by said first fastener.

5. The apparatus as recited in claim 4, wherein said second guide part further comprises a recess defined in part by a surface of revolution that forms an arc greater than 180 degrees and a surface that extends from one end of said surface of revolution to an edge of said slot.

6. The apparatus as recited in claim 5, wherein said retaining pin comprises an end portion that projects into and is constrained by said surface of revolution of said recess in said second guide part when said retainer is in said first state, said end portion of said retaining pin being clear of said recess when said retainer is in said second state.

7. The apparatus as recited in claim 4, wherein said second guide part further comprises a circular bore penetrated by said second fastener, said radiused slot having a radius centered at a center line of said bore, whereby said second guide part is rotatable about said second fastener through an angle determined by an arc length of said radiused slot when said retainer is in said second state.

8. The apparatus as recited in claim 3, wherein said retainer further comprises a compression spring having one end in contact with a portion of said first fastener and another end in contact with a portion of said retaining pin.

9. The apparatus as recited in claim 3, wherein said retainer further comprises a compression spring arranged to resist movement of said retaining pin in a first direction along said first fastener.

10. The apparatus as recited in claim 3, wherein said retaining pin comprises a bore, said bore comprising first and second bore sections, said first bore section being in the form of a circular cylindrical space having a predetermined radius slightly greater than a radius of said first fastener, and said second bore section having a transverse dimension greater than said predetermined radius, a portion of said first fastener projecting into said bore section, further comprising a spring retained between said retaining pin and said first fastener inside said second bore section.

11. The apparatus as recited in claim 1, wherein said first guide part further comprises a first guide blade and said second guide part further comprises a second guide blade, said first and second guide blades respectively comprising first and second straight edges that extend in parallel spaced relationship when said second guide part is in said extended position, said first straight edge of said first guide blade being substantially aligned with an edge of said first groove, and said second straight edge of said second guide blade being substantially aligned with an edge of said second groove.

12. The apparatus as recited in claim 1, wherein said first guide part further comprises a first surface on one side of said first groove and a second surface on the other side of said first groove, and said second guide part further comprises a third surface on one side of said second groove and a fourth surface on the other side of said second groove, said first and third surfaces being mutually opposed and separated by a first spacing, and said second and fourth surfaces being mutually opposed and separated by a second spacing, said first and second spacings being different.

13. A slider insertion apparatus comprising:

a zipper guide for guiding a zipper tape during longitudinal movement and supporting said zipper tape during slider insertion;

a pusher for inserting a slider onto a first section of said zipper tape; and an activator for activating a second section of said zipper tape, wherein said first and second sections overlap, wherein said zipper guide comprises first and second guide parts having first and second grooves respectively, said first guide part being fixed and said second guide part being movable between extended and retracted positions, said first and second grooves being opposed to each other when said second guide part is in said extended position and not opposed to each other when said second guide part is in said retracted position.

14. The apparatus as recited in claim 13, further comprising a first fastener and a retainer coupled to said first fastener and having first and second states, said retainer being coupled to said second guide part in said first state and being uncoupled from said second guide part in said second state, wherein said second guide part is locked in said extended position when said retainer is in said first state, and said second guide part is movable between said extended position and said retracted position when said retainer is in said second state.

15. The apparatus as recited in claim 14, wherein said retainer comprises a retaining pin slidable on said first fastener.

16. The apparatus as recited in claim 15, wherein said second guide part comprises a radiused slot penetrated by said first fastener.

17. The apparatus as recited in claim 16, further comprising a second fastener, wherein said second guide part further comprises a circular bore penetrated by said second fastener, said radiused slot having a radius centered at a center line of said bore, whereby said second guide part is rotatable about said second fastener through an angle determined by an arc length of said radiused slot when said retainer is in said second state.

18. The apparatus as recited in claim 13, wherein said second guide part is pivotable, said extended position being a first angular position and said retracted position being a second angular position different than said first angular position.

19. The apparatus as recited in claim 13, wherein a closed section of said zipper tape is disposed between said first and second grooves, said first and second grooves having profiles that guide said closed section of said zipper in a longitudinal direction only.

20. The apparatus as recited in claim 13, wherein said first guide part further comprises a first guide blade and said second guide part further comprises a second guide blade, said first and second guide blades respectively comprising first and second straight edges that extend in parallel spaced relationship when said second guide part is in said extended position, said first straight edge of said first guide blade being substantially aligned with an edge of said first groove, and said second straight edge of said second guide blade being substantially aligned with an edge of said second groove.

21. The apparatus as recited in claim 13, wherein said first guide part further comprises a first surface on one side of said first groove and a second surface on the other side of said first groove, and said second guide part further comprises a third surface on one side of said second groove and a fourth surface on the other side of said second groove, said first and third surfaces being mutually opposed and separated by a first spacing, and said second and fourth surfaces being mutually opposed and separated by a second spacing, said first and second spacings being different.

22. A slider insertion apparatus comprising:

an assembly for inserting sliders onto a zipper tape; and a zipper guide for guiding said zipper tape during longitudinal movement of said zipper tape and supporting said zipper tape during slider insertion, wherein said zipper guide comprises first and second grooves and a spring-loaded release mechanism, said first and second grooves being opposed to each other when said zipper guide is in a first state and not opposed to each other when said zipper guide is in a second state, said zipper guide being transformed from said first state to said second state by manual operation of said release mechanism.

23. The apparatus as recited in claim 22, wherein a closed section of said zipper tape is disposed between said first and second grooves, said first and second grooves having profiles that guide said closed section of said zipper tape in a longitudinal direction only.

24. A slider insertion apparatus comprising:

an assembly for inserting sliders onto a zipper tape;

first and second shafts that are fixed relative to said assembly;

a zipper guide for guiding said zipper tape during longitudinal movement of said zipper tape and supporting said zipper tape during slider insertion, wherein said zipper guide comprises a stationary part that is fixed relative to said assembly and comprises a first groove, and a rotatable part that is rotatable about said second shaft between first and second angular positions and comprises a second groove; and a retainer coupled to said first shaft and movable between first and second retainer positions, said retainer being coupled to said rotatable part in said first retainer position to block rotation of said rotatable part and being uncoupled from said rotating part in said second retainer position to not block rotation of said rotatable part.

25. The apparatus as recited in claim 24, wherein said retainer comprises a retaining pin slidable on said first shaft.

26. The apparatus as recited in claim 25, further comprising a spring that opposes sliding of said retaining pin from said first retainer position to said second retainer position.

27. The apparatus as recited in claim 24, wherein said rotating part of said zipper guide comprises a radiused slot penetrated by said first shaft.

28. The apparatus as recited in claim 27, wherein said rotating part further comprises a recess, and said retainer pin further comprises an end portion that fits in said recess, said rotating part being not rotatable when said end portion of said retainer pin is inserted in said recess.

29. A method of loading a slider insertion machine with zipper tape, comprising the following steps:

unlatching a rotatable guide part;

rotating said unlatched rotatable guide part from a first angular position where a first groove of said rotatable guide part confronts a second groove of a stationary guide part to a second angular position where said first groove does not confront said second groove;

laying a zipper tape on said stationary guide part in a position whereat a zipper profile is seated in said second groove;

rotating said rotatable guide part from said second angular position to said first angular position without moving said zipper profile out of said second groove; and latching said rotatable guide part.

30. The method as recited in claim 29, wherein said latching and unlatching steps are performed by manipulation of a spring-loaded pin that respectively engages with and disengages from said rotatable guide part.

* * * * *